US008707488B2

(12) United States Patent
Riley et al.

(10) Patent No.: US 8,707,488 B2
(45) **Date of Patent: *Apr. 29, 2014**

(54) MULTIPLE CONFIGURATION AIR MATTRESS PUMP SYSTEM

(75) Inventors: John J. Riley, Brookfield, WI (US); Richard A. Feingold, Lake Bluff, IL (US)

(73) Assignee: Rapid Air LLC, Pewaukee, WI (US)

( * ) Notice: Subject to any disclaimer, the term of this patent is extended or adjusted under 35 U.S.C. 154(b) by 721 days.

This patent is subject to a terminal disclaimer.

(21) Appl. No.: 12/907,723

(22) Filed: Oct. 19, 2010

(65) Prior Publication Data

US 2011/0073202 A1 Mar. 31, 2011

Related U.S. Application Data

(63) Continuation of application No. 11/869,334, filed on Oct. 9, 2007, now Pat. No. 7,886,387.

(60) Provisional application No. 60/897,616, filed on Jan. 26, 2007.

(51) Int. Cl.
*A47C 27/08* (2006.01)
*A47C 27/10* (2006.01)

(52) U.S. Cl.
USPC ..... 5/713; 5/706

(58) Field of Classification Search
USPC ..... 5/713, 710, 706, 708, 644, 654, 655.3
See application file for complete search history.

(56) References Cited

U.S. PATENT DOCUMENTS

| | | | |
|---|---|---|---|
| 2,781,780 | A | 2/1957 | Zahradka |
| 3,499,464 | A | 3/1970 | Williams et al. |
| 3,552,436 | A | 1/1971 | Stewart |
| 3,566,917 | A | 3/1971 | White |
| 3,625,474 | A | 12/1971 | Juede |
| 3,784,994 | A | 1/1974 | Kery |
| 3,785,403 | A | 1/1974 | Kirk |
| 3,918,489 | A | 11/1975 | Foster et al. |
| 3,949,784 | A | 4/1976 | Duthion et al. |
| 4,230,143 | A | 10/1980 | Dettmann et al. |
| 4,394,784 | A | 7/1983 | Swenson et al. |
| 4,498,500 | A | 2/1985 | Miller |
| 4,568,026 | A | 2/1986 | Baun |
| 4,725,040 | A | 2/1988 | Fornuto et al. |
| 4,736,774 | A | 4/1988 | Vonasek |
| 4,768,559 | A | 9/1988 | Hehl |

(Continued)

FOREIGN PATENT DOCUMENTS

CA 2000534 4/1990

OTHER PUBLICATIONS

Jul. 18, 2012, Office Action in Co-Pending U.S. Appl. No. 12/914,805.

(Continued)

*Primary Examiner* — Robert G Santos
(74) *Attorney, Agent, or Firm* — Jennifer L. Gregor; Brian G. Gilpin; Godfrey & Kahn, S.C.

(57) ABSTRACT

A multiple configuration air mattress pump system is disclosed. The pump system includes a number of standard components with a few inexpensive varied components to allow for easy and less expensive use of the pump with mattresses having varying numbers of inflatable zones.

12 Claims, 17 Drawing Sheets

(56) References Cited

U.S. PATENT DOCUMENTS

| | | | |
|---|---|---|---|
| 4,829,616 | A | 5/1989 | Walker |
| 4,838,309 | A | 6/1989 | Goodwin |
| 4,890,344 | A | 1/1990 | Walker |
| 4,898,360 | A | 2/1990 | VonHayn et al. |
| 4,949,413 | A | 8/1990 | Goodwin |
| 4,982,466 | A | 1/1991 | Higgins et al. |
| 4,986,738 | A | 1/1991 | Kawasaki et al. |
| 5,005,240 | A | 4/1991 | Vrzalik |
| 5,020,176 | A | 6/1991 | Dotson |
| 5,044,029 | A | 9/1991 | Vrzalik |
| 5,142,719 | A | 9/1992 | Vrzalik |
| 5,421,044 | A | 6/1995 | Steensen |
| 5,836,296 | A | 11/1998 | Hillis et al. |
| 5,903,941 | A | 5/1999 | Shafer et al. |
| 5,904,172 | A | 5/1999 | Gifft et al. |
| 5,967,188 | A | 10/1999 | Chien-Chuan |
| 5,983,429 | A | 11/1999 | Stacy et al. |
| 6,036,107 | A | 3/2000 | Aspen et al. |
| 6,037,723 | A | 3/2000 | Shafer et al. |
| 6,115,860 | A | 9/2000 | Vrzalik |
| 6,223,369 | B1 | 5/2001 | Maier et al. |
| 6,302,145 | B1 | 10/2001 | Ellis et al. |
| 6,340,034 | B1 | 1/2002 | Arnott et al. |
| 6,363,971 | B1 | 4/2002 | Kaylan et al. |
| 6,390,445 | B2 | 5/2002 | Fukano |
| 6,453,948 | B2 | 9/2002 | Notz et al. |
| 6,483,264 | B1 | 11/2002 | Shafer et al. |
| 6,550,086 | B2 | 4/2003 | Boyd |
| 6,591,437 | B1 | 7/2003 | Phillips |
| 6,648,019 | B2 | 11/2003 | Gagnon |
| 6,889,709 | B2 | 5/2005 | Hanada et al. |
| 7,007,917 | B2 | 3/2006 | Choi et al. |
| 7,106,158 | B2 | 9/2006 | Forsythe et al. |
| 7,114,472 | B2 | 10/2006 | Kondo |
| 7,414,502 | B2 | 8/2008 | Tackes et al. |
| 7,886,387 | B2 * | 2/2011 | Riley et al. ..... 5/713 |
| 8,176,921 | B2 * | 5/2012 | Bazargani ..... 128/848 |
| 2001/0045230 | A1 * | 11/2001 | Olson et al. ..... 137/363 |
| 2005/0263196 | A1 | 12/2005 | Hsieh |
| 2006/0027273 | A1 | 2/2006 | Schwarz |
| 2007/0061976 | A1 * | 3/2007 | Bazargani ..... 5/644 |
| 2008/0181795 | A1 | 7/2008 | Feingold et al. |
| 2011/0073202 | A1 * | 3/2011 | Feingold et al. ..... 137/565.17 |
| 2011/0258783 | A1 * | 10/2011 | Rickman et al. ..... 5/710 |
| 2011/0265898 | A1 * | 11/2011 | Driscoll, Jr. ..... 137/565.16 |
| 2012/0240340 | A1 * | 9/2012 | Driscoll et al. ..... 5/710 |
| 2012/0304391 | A1 * | 12/2012 | Driscoll et al. ..... 5/710 |
| 2013/0031725 | A1 * | 2/2013 | Riley et al. ..... 5/713 |

OTHER PUBLICATIONS

Jan. 18, 2013, Response to Office Action in Co-Pending U.S. Appl. No. 12/914,805.

International Search Report for PCT/US 08/52064 filed Jan. 25, 2008; mailed Aug. 1, 2008.

* cited by examiner

MULTIPLE CONFIGURATION AIR MATTRESS PUMP SYSTEM

CROSS REFERENCE TO RELATED APPLICATIONS

This application is a continuation of and claims the benefit under 35 U.S.C. §120 of U.S. application Ser. No. 11/869,334, filed Oct. 9, 2007, now U.S. Pat. No. 7,886,387, which claims priority under 35 U.S.C. §119 to U.S. Provisional Application No. 60/897,616, filed Jan. 26, 2007. The foregoing applications are both specifically incorporated herein by reference for all purposes.

FIELD OF THE INVENTION

This invention relates generally to the field of air mattresses. More specifically, it relates to a pump system that can be used with mattresses having a varying number of individually-inflatable zones. The pump system has a common platform and a manifold that can accommodate a range of pump sizes, differing numbers of air control valves, and varied configurations of faceplates for easy and cost-effective manufacturing and use with mattresses that have different numbers of inflatable zones.

BACKGROUND

Pumps for mattresses are well known for providing controlled air flow to inflatable mattresses. One such system is disclosed in U.S. Pat. No. 5,044,029 to Vrzalik. Vrzalik teaches an air control system wherein the bed and frame itself incorporates the system, and therefore greatly increases the cost of manufacturing by requiring integration of the controls into the mattress. Another air control mechanism, which is external to the bed itself, is disclosed in U.S. Pat. No. 6,037,723 to Schafer. A major limitation of this and other similar air control systems is that the systems can inflate only the specific number of chambers for which they are designed, and can therefore be used only with mattresses containing the matching number of inflatable chambers. Separate pumps therefore need to be manufactured for each type of mattress model.

The requirement for existing pumps to be customized to accommodate the number of inflatable chambers in the mattress with which they will be used greatly increases manufacturing costs and time, and decreases overall market efficiency by requiring a unique pump for each style of bed. None of the existing airbed control systems currently in use provide an interchangeable, efficient pump system, but rather are manufactured and sold with substantial differences in appearance, internal design, and component configuration for use with mattresses with varying numbers of zones. The mechanical and software designs presently used are typically single-pump based and require a manufacturer to create new tool sets for internal components, new circuit board designs, and new external enclosures to create the different pump systems with respect to the number of air zones to be controlled. Existing pump systems do not lend themselves to the development or sale of a comprehensive product line that can be easily and cost-effectively configured to produce multiple finished products that have significantly differentiated functionality but a consistent overall appearance.

Accordingly, a need exists for a multiple configuration pump system in which a variety of pump sizes and face plates as well as varying number of air control valves can be incorporated into a standard platform and manifold for use with mattresses having different numbers of inflatable zones. This system provides the components that are the most expensive to tool as the common universal components, and the least expensive and simply-tooled components to be the variable ones. Inventory can be built to a nearly-finished state, and quickly and inexpensively configured with the variable components at the last moment based on actual market demand.

Furthermore, such a system solves the current problems of an increased expense of manufacturing multiple types of pump systems for use with mattresses having different numbers of zones, and also provides a universal pump for convenience of retailers and consumers. A multiple configuration system also allows for streamlined testing procedures and lower testing costs, such as standard durability drop tests, form, fit and function tests, and compliance tests across the configurations. The standardized pump systems also allow for use of the same packaging for each pump system, including both the inner packaging and outer shipping box, fewer inventory SKUs, standardized packaging lines, processes and employee training, and standardized pallet size and storage requirements.

SUMMARY

The present invention provides a multiple configuration mattress pump. The pump system includes a manifold which is adapted to connect a varying number of air control valves to control air flow to the related number of inflatable mattress zones. The platform can accommodate a variety of pump sizes. Additionally, the platform is adapted to easily hold changeable faceplates containing a number of tube holes corresponding to the number of mattress zones. The number of plugs used to fill the holes in the manifold for unused air control valves for use with beds having fewer than the maximum number of zones can vary. The pump system includes a circuit board which fits onto the platform, the software of which can be programmed to match the number of air control valves corresponding to each inflatable zone. The invention may include a wired or wireless pendant connected to the circuit board of the platform, allowing the user to control the airflow in each inflatable zone. The invention may also include a pony board with a number of connection ports equal to the maximum number of air control openings in the manifold, with the output wires contained in a single arm and allowing for a single connection from the valves to the circuit board where multiple valves are used.

The present invention has several advantages and benefits over the prior art. Other objects, features and advantages of the present invention will become apparent after reviewing the following detailed description.

DETAILED DESCRIPTION OF THE PREFERRED EMBODIMENTS

Figure 1:
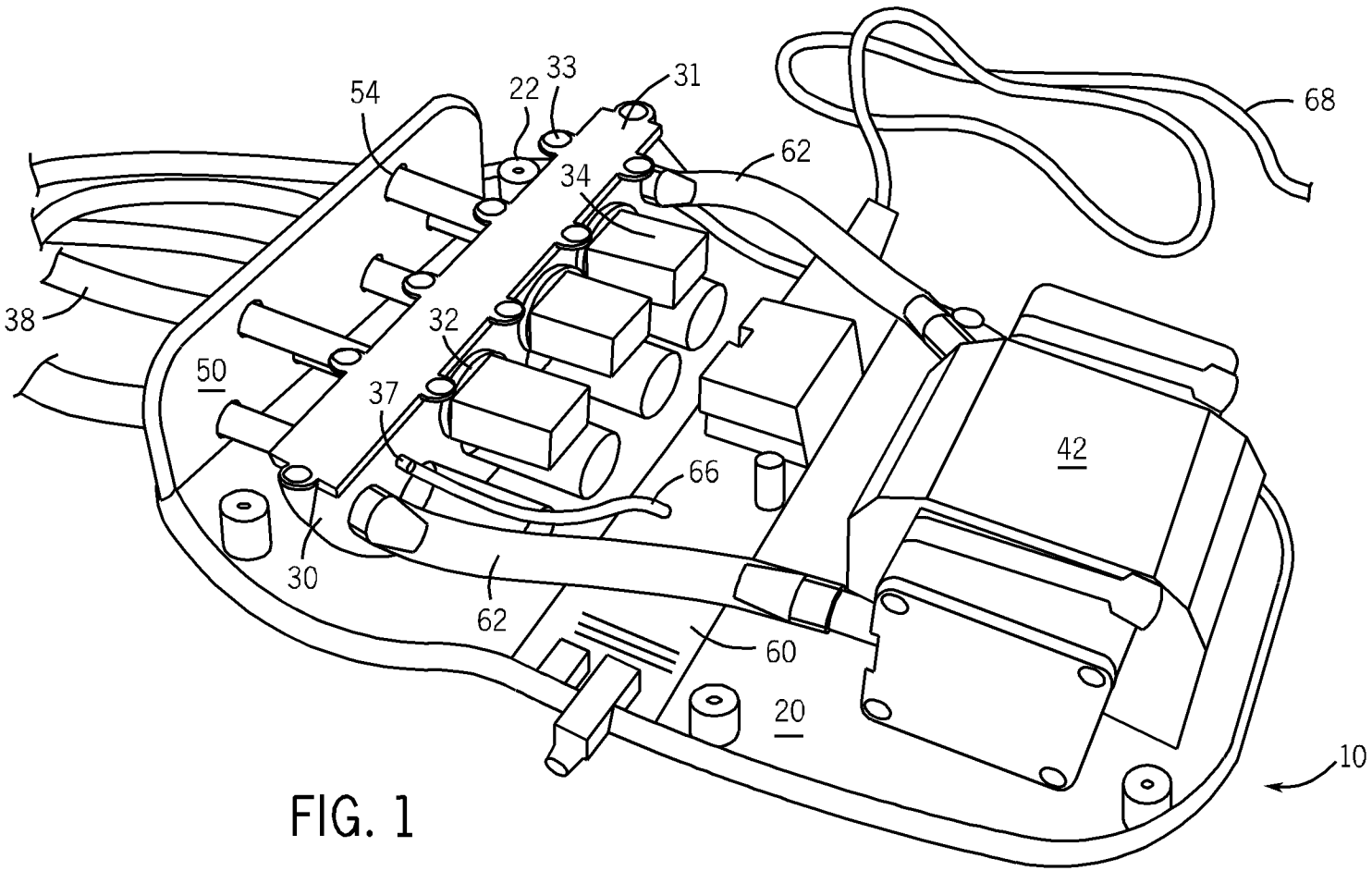
FIG. 1 is a side perspective view of an air mattress pump system in accordance with one embodiment of the present invention shown without an enclosure top and with certain details removed.

Referring now to the drawings, FIGS. 1-6 are views of a multiple configuration airbed pump system 10 in accordance with a preferred embodiment of the present invention. The pump system 10 may include a pump casing consisting of a platform 20 and an enclosure top 80. The system may further include a manifold 30 for controlling airflow and including air valves 35 and a pressure management valve 37, air control valves 34, air control plugs 36, zone tubing 38, a pump mounting area 40 for receiving a pump 42, an interchangeable faceplate 50, a primary circuit board 60, internal tubing 62, a pressure management tube 66 and a pendant 70. The platform 20, manifold 30, zone tubing 38, mounting base 40, circuit board 60, internal tubing 62, pressure management tube 66, pendant 70 and enclosure top 80, are the shared components of the system, and can be used with mattresses varying from one to six individual inflatable zones. Of course, the system 10 could be used with mattresses having other numbers of zones if desired by modifying the manifold 30 to include additional air valves 35. The faceplate 50, number of air control valves 34 and number of air control plugs 36 are the only components that vary in the use of the system 10 with different mattresses. The software of the circuit board 60 can be programmed to correspond to the number of zones to be inflated.

Figure 2:
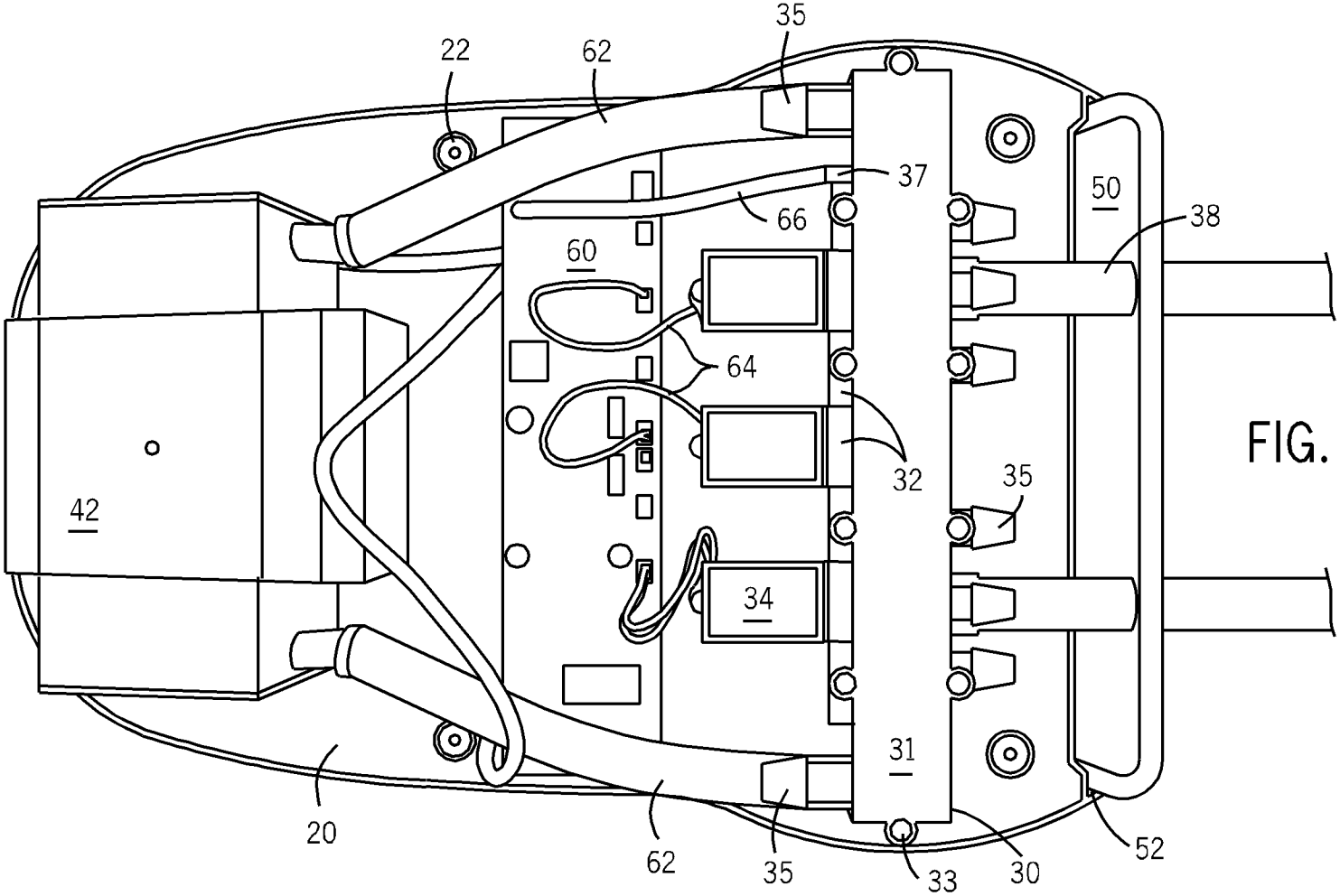
FIG. 2 is a top view of a pump system in accordance with one embodiment of the present invention shown without an enclosure top.
Figure 3:
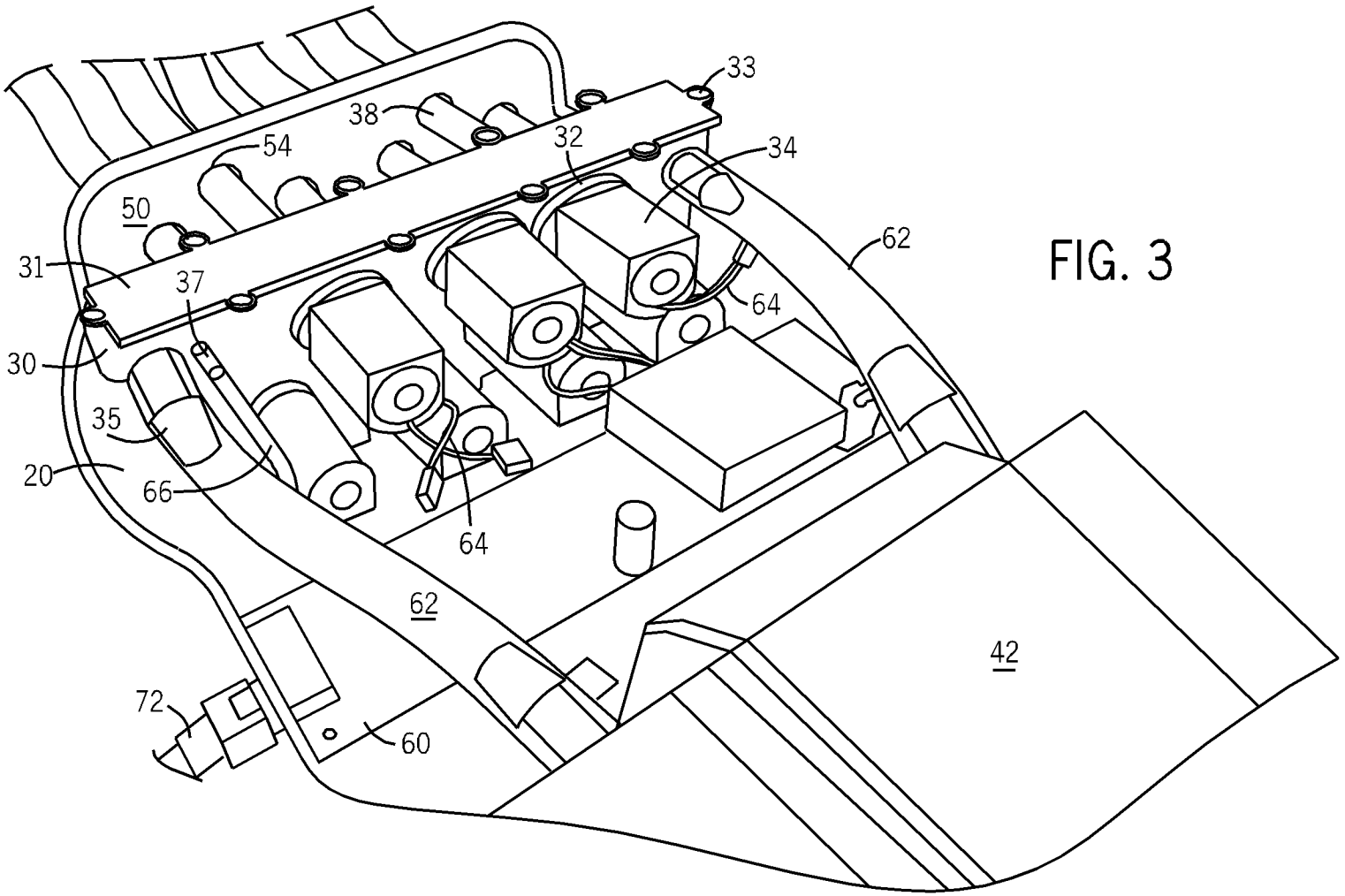
FIG. 3 is a detail side perspective view of a pump system in accordance with one embodiment of the present invention shown without an enclosure top.
Figure 11:
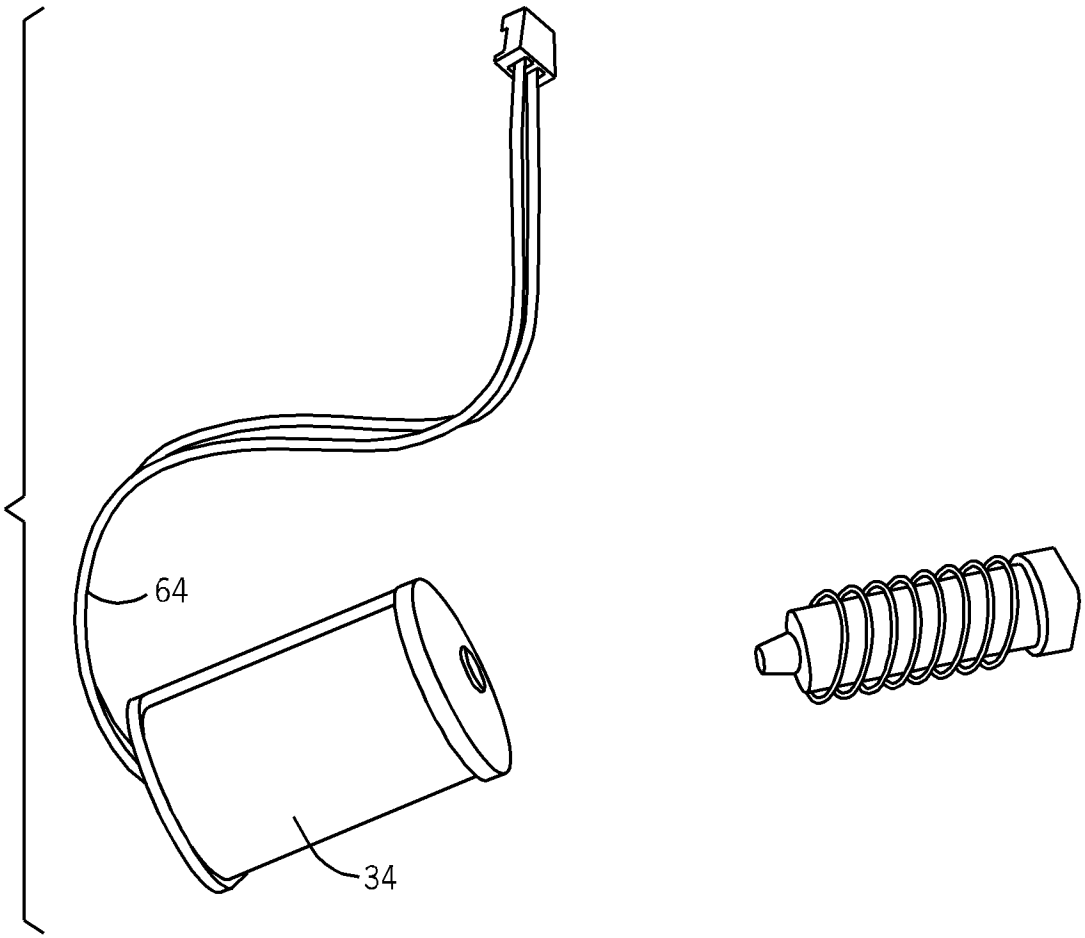
FIG. 11 is a top perspective view of an air control valve in accordance with one embodiment of the present invention.

As seen in FIGS. 1-3, the manifold 30 and circuit board 60 can be mounted to the platform 20, and the platform 20 may have a pump area 40 for holding a pump 42. The use of a manifold 30 is well-known in the art as a component for regulating air flow pumped from a pump 42 to air chambers. A diaphragm pump is shown, but other types of pumps could be used. The platform 20 can also include a slot 52 for holding an changeable faceplate 50. The platform 20 may also include screw holes 22 for attaching the manifold 30, circuit board 60, and pump 42, as well as for attaching the enclosure top 80 (FIG. 11). Of course, other means of attaching the enclosure top 80 to the platform 20, such as adhesives, sonic welding, or snap-fitting, may also be used.

Figure 12:
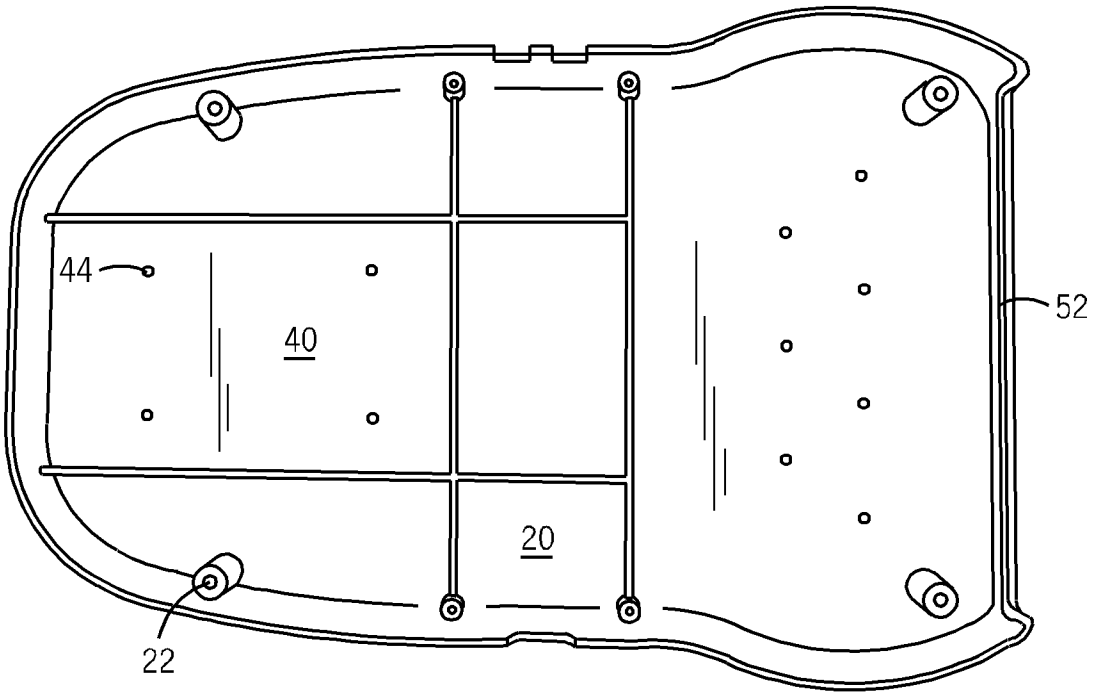
FIG. 12 is a top view of a platform of a pump system in accordance with one embodiment of the present invention.
Figure 13:
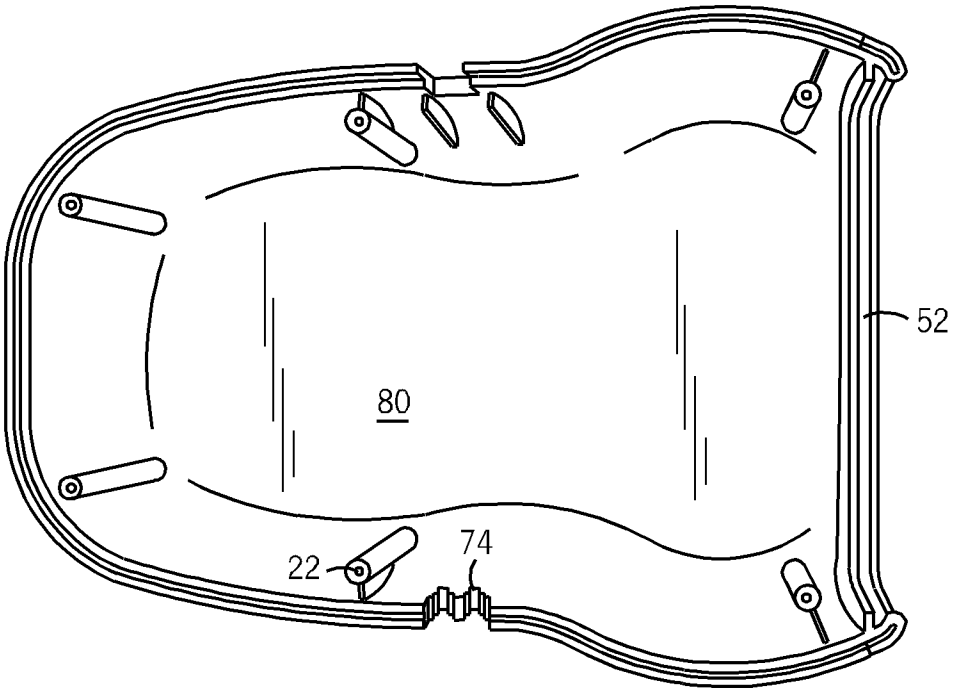
FIG. 13 is an underside view of a top enclosure of a pump system in accordance with one embodiment of the present invention.

As seen in FIG. 2, the assembled pump system 10 with the enclosure top 80 secured to the platform 20 is identical for pump systems 10 used with, for example, six-, four-, and two-zone mattresses, with the exception of the faceplate 50 and number of zone tubes 38 exiting the faceplate 50. This allows continuity in the overall product line, in addition to the cost savings, in using such an interchangeable pump system 10. As the casing platform 20 and enclosure top 80 (FIGS. 12-13) are two of the more intricate and therefore expensive components to tool in manufacturing, the standardization provides cost savings by allowing these expensive components to be used across the entire product line, with any mattress model. The standardized platform 20 and enclosure top 80 casing also allow for standardized packing, shipping, and storage of the pump systems 10 to be used with the varying mattress models. The standardized casing also provides brand equity by keeping the same overall look across multiple price points and SKUs, and also provides packaging and advertising cost savings.

Figure 7:
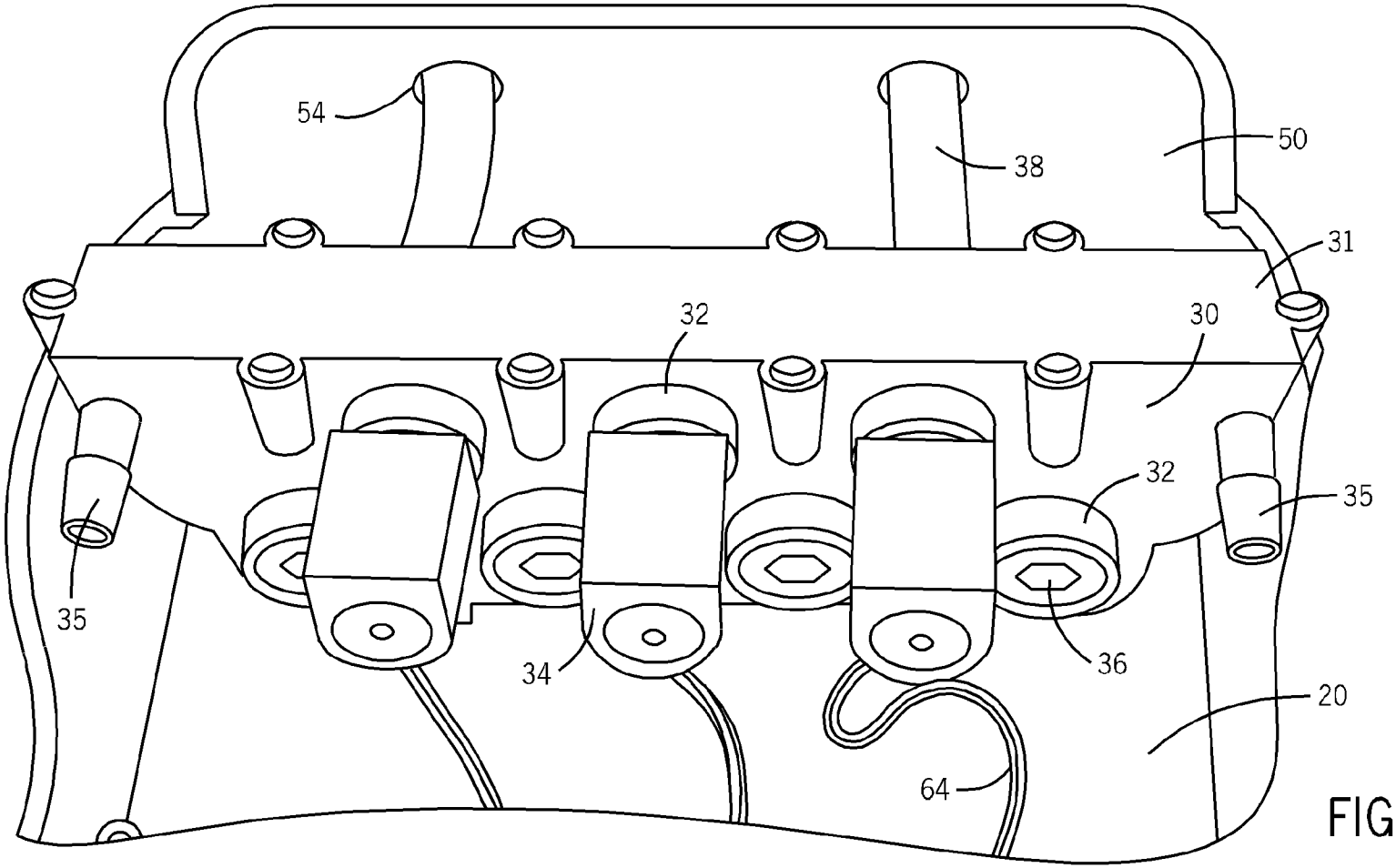
FIG. 7 is a rear perspective view of a manifold and a faceplate in a two-zone configuration of a pump system.
Figure 8:
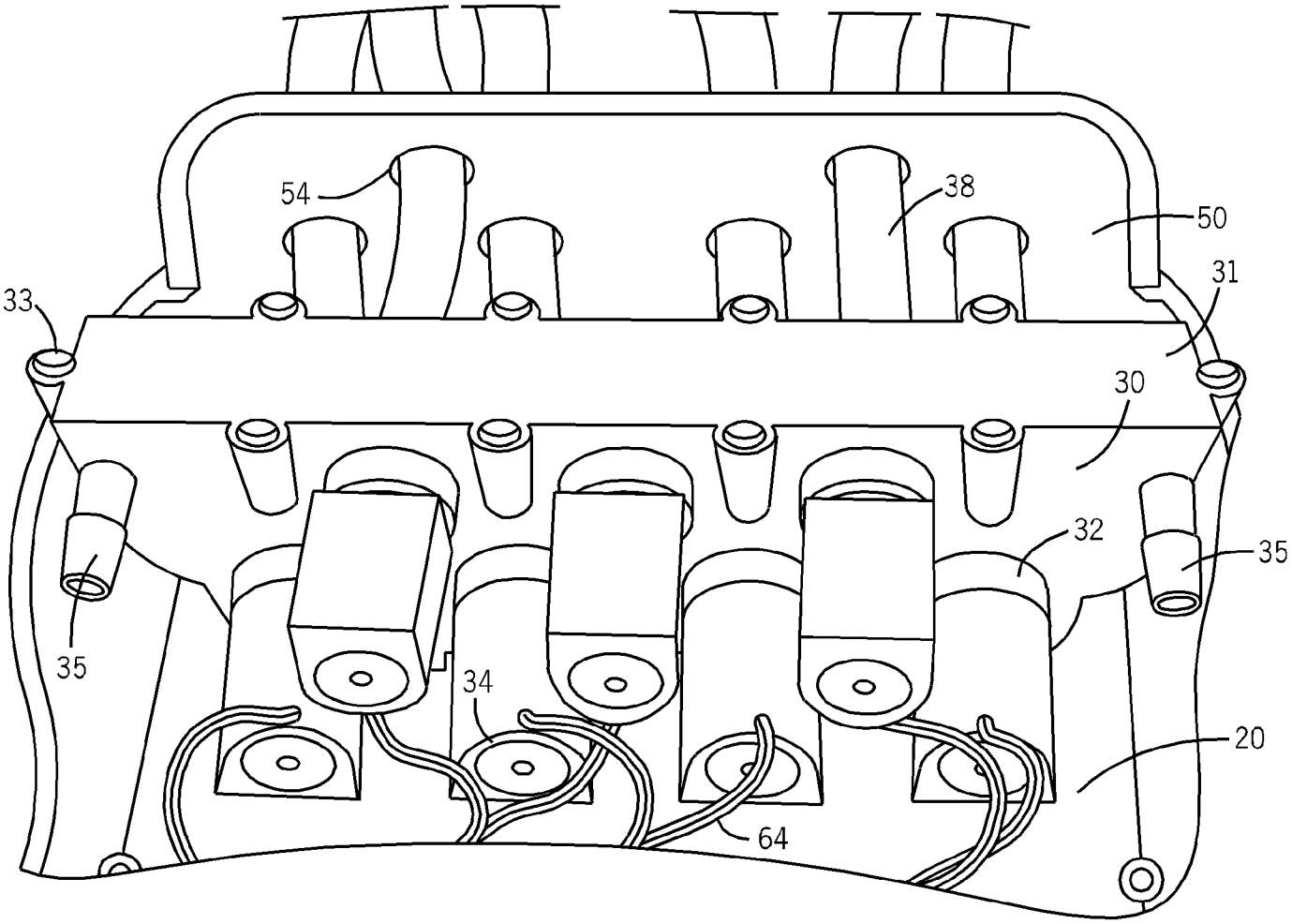
FIG. 8 is a rear perspective view of a manifold and faceplate in a six-zone configuration of a pump system.

Referring now to FIGS. 3-4, 7-8 and 10, one side of a manifold 30 includes air control holes 32. In the embodiment shown, seven air control holes 32 are shown. This allows up to seven air control valves 34 to be inserted into the holes 32 of the manifold 30 for a six-zone mattress, with six air control valves 34 used for air flow to the zones, and one air control valve 34 for exhaust. Solenoid valves (FIG. 11) are shown but other types of air control valves 34 could be used. Of course, manifolds 30 with more or fewer air control holes 32 could be manufactured to accommodate mattresses with more or fewer than six inflatable zones. The manifold 30 includes a cover 31 which can be connected with screws using manifold screw holes 33. Having a standardized manifold 30, the most expensive component due to its complexity and detailed tooling, provides a large cost savings. When fewer than the maximum number of zones are being inflated, the corresponding number of air control valves 34 can be used, and air control plugs 36 can be used to block the empty holes 32 not being used. For example, in the embodiment shown, in a mattress with only two zones, three air control valves 34 would be used (two for air flow to the zones, one for exhaust), and four air control plugs 36 would be inserted into the four unused holes 32. FIG. 7 shows a system 10 configured for a two-zone mattress, with the manifold 30 having three air control valves 34 and four air control plugs 36 blocking the unused holes 32. FIG. 8 shows a system 10 configured for a six-zone mattress, with the manifold 30 having seven air control valves 34 and therefore no air control plugs 36. The air control plugs 36 (FIG. 10) fit any hole 32 in the manifold 30 and are very inexpensive to manufacture; having these air control plugs 36 as one of the variable components therefore allows for only a small cost to change the configuration for use with different mattress models. It also allows for volume discounts, in that the same parts can be used across different SKUs.

As seen in the embodiment shown in FIGS. 1-3, two air valves 35 are connected by internal tubing 62 to the pump 42, whereby air is pumped from the pump 42 to the manifold 30. On the opposite side of the manifold 30, air valves 35 are coupled to each of the seven holes 32. For each zone of the mattress that is to be inflated, a zone tube 38 is attached to the air valve 35 opposite an air control valve 34 and runs to an inflatable zone of the mattress. The manifold 30 is one of the more difficult and expensive components to tool for manufacturing, but, by simply plugging any unused holes 32 with plugs 36, the manifold 30 can be used with beds ranging from, in the embodiment shown in the FIGS., one to six inflatable zones without any additional manufacturing or machining costs.

Figure 6:
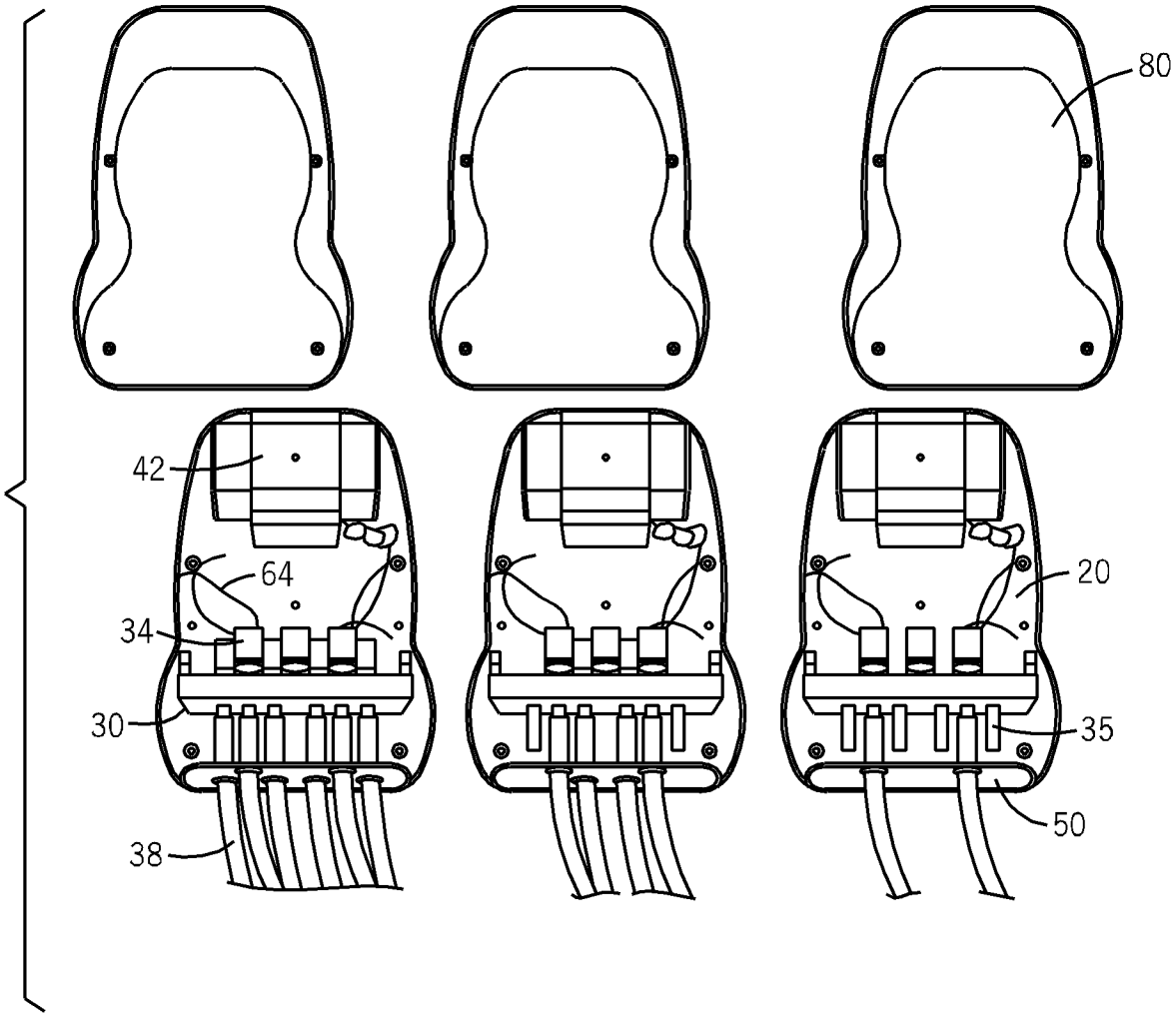
FIG. 6 is a top view of the three configurations of pump systems of FIG. 5, shown without enclosure tops.
Figure 9:
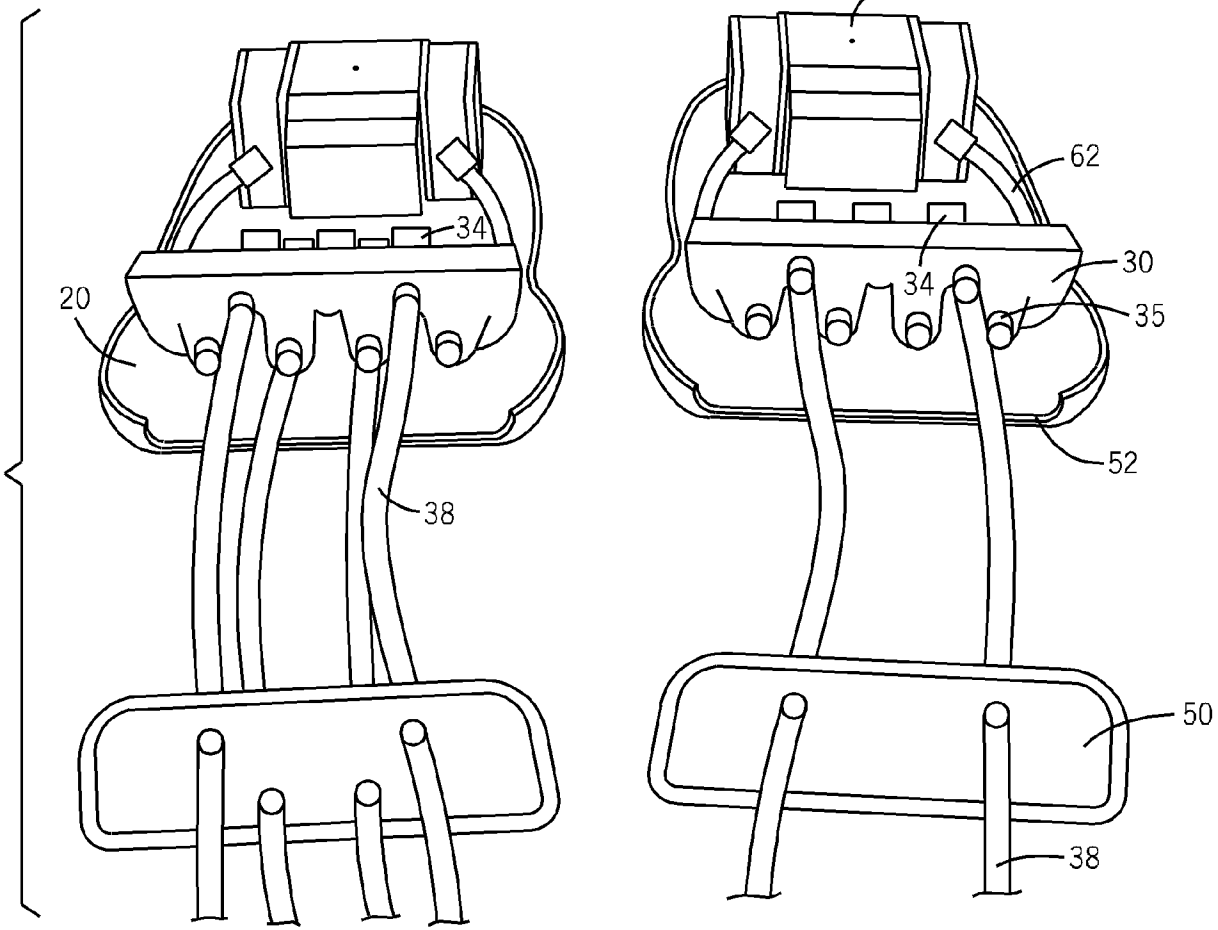
FIG. 9 is a front perspective view of a manifold, zone tubing and faceplates of two configurations of pump systems shown without enclosure tops.
Figure 10:
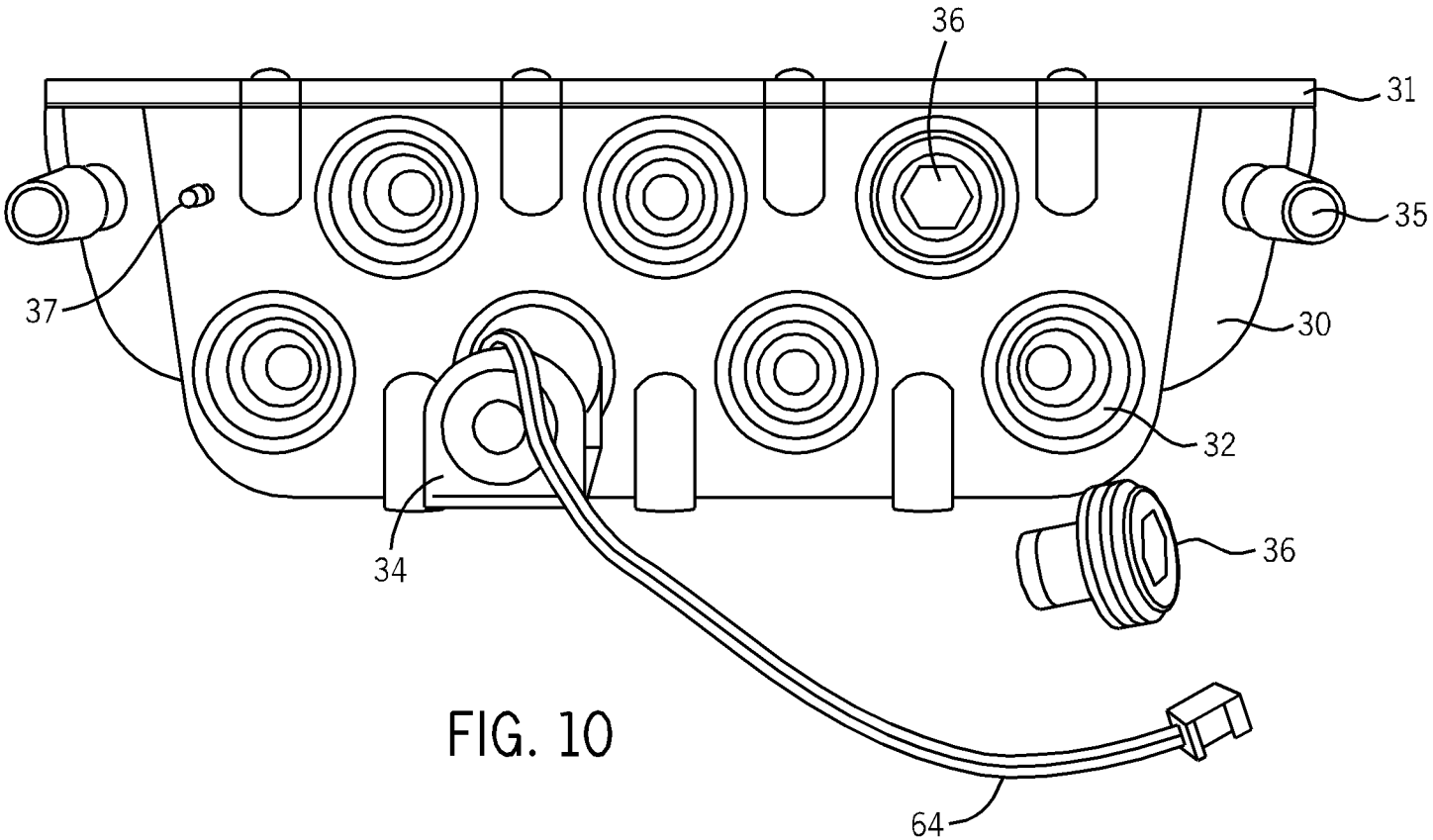
FIG. 10 is a rear view of a manifold with an air control valve and air control plugs in accordance with one embodiment of the present invention.

Referring now to FIGS. 1, 6, and 9, the faceplate 50 includes openings 54 through which the zone tubes 38 can pass. In a preferred embodiment, the faceplate 50 fits into a slot 52 in the casing platform 20 and top enclosure 80. Faceplates 50 can therefore be changed to accommodate the number of zone tubes 38 (and air control valves 34) corresponding to the number of inflatable zones in each particular mattress. Where a mattress has four inflatable zones, for example, a faceplate 50 with four openings 54 would be placed in the slot 52, and four tubes 38 would run from the air valves 35 opposite the air control valves 34, through the openings 54 and to each zone of the mattress. The faceplates 50 are a small and inexpensive component of the pump 10, and requiring only this component to be manufactured differently for use of the pump 10 with different mattresses saves time and money. Additionally, the faceplate 50 protects the tube 38 connections to the air valves 35. Some pump systems currently on the market have the tube connections exposed, which subjects the existing pump systems to a greater risk of breakage. This "hiding" of the internal components in the pump system 10 of the present invention also adds aesthetic value to the system 10 giving it an overall clean, finished look.

The platform 20 in a preferred embodiment also includes a pump mounting area 40 for supporting a pump 42. A diaphragm pump is shown, but other types of air pumps could also be used. The mounting area 40 in the embodiment shown in FIG. 12 includes four pump screw holes 44 by which the pump 42 can be secured. Of course, the mounting area 40 could be configured differently and include a different number and configuration of pump screw holes 44 depending on the pump 42 used. Alternative methods of securing the pump 42 to the mounting area 40 of the platform 20 could also be used. The mounting area 40 is sized such that a variety of types and sizes of pumps 42 can be used with the pump system 10. Internal tubing 62 connects the pump 42 to the manifold 30 to pump air from the manifold 30 to the mattress zones.

As seen in FIGS. 1-3, a circuit board 60 may also be affixed to the platform 20. The circuit board 60 contains software programmable for the varying number of zones to be inflated. It also contains all connection assemblies for system power and for the pendant 70 used by the mattress user to control the inflation of the zones. The air control valves 34 can be connected to the circuit board 60 by connective wires 64, and air flow is controlled by the user selecting desired firmness on the pendant 70 which is connected to the circuit board 60. This allows the corresponding amount of air to be pumped to each zone based on the firmness level selected by the user on the pendant 70. A pressure measurement tube 66 connects a pressure management valve 37 on the manifold 30 to the circuit board 60 to allow the software to determine the pressure in the manifold 30 to control the proper release of air for the firmness selected by the user. The circuit board 60 can be used for any configuration of air control valves 34 and pump sizes 42 by loading it with the appropriate software program. A power cord 68 may be attached to the circuit board 60 to provide power to the pump system 10. The power cord 68 may alternatively be attached through a transformer (not shown) depending on circuitry design. In a preferred embodiment, the power cord 68 passes through the top enclosure 80 and/or the platform 20 of the casing.

Figure 16:
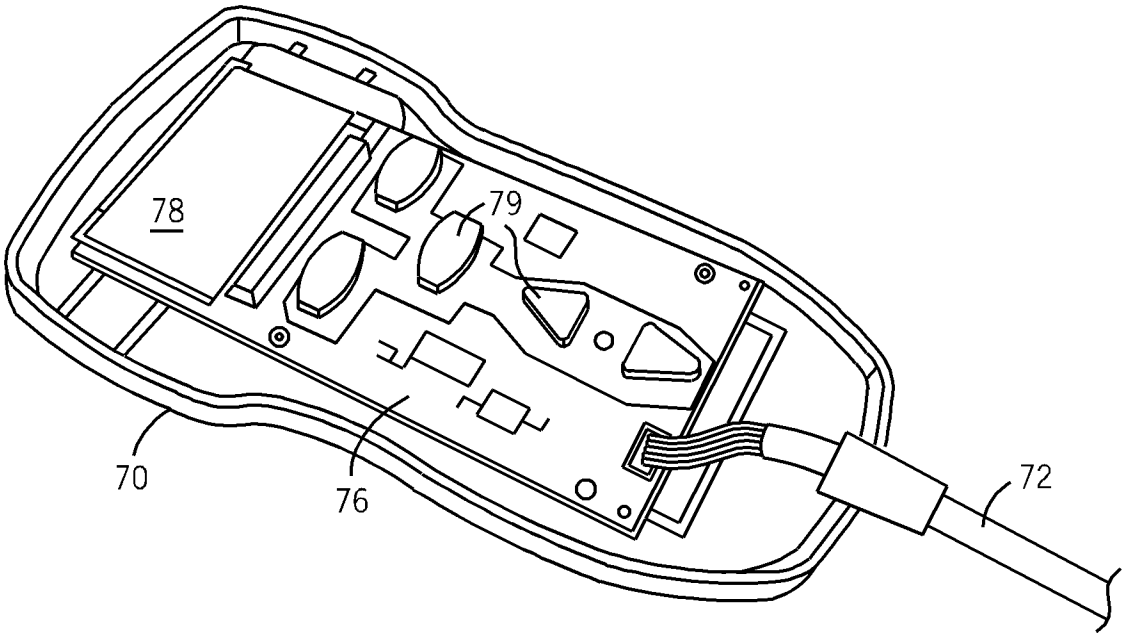
FIG. 16 is a side perspective view of a pendant circuit board in accordance with one embodiment of the present invention, shown with the cover removed.
Figure 17:
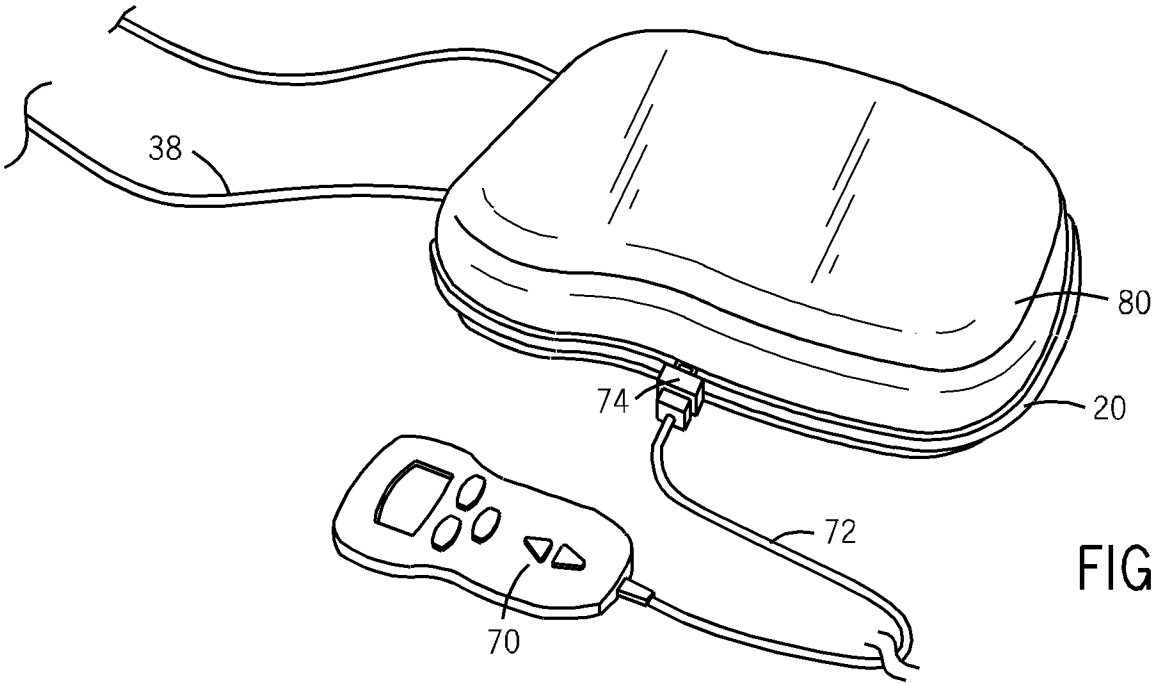
FIG. 17 is a side perspective view of a pendant attached to a pump system with an enclosure top in accordance with one embodiment of the present invention.

As shown in FIGS. 1 and 16-17, a pendant 70 can be connected to the circuit board 60 via a pendant cord 72. An aperture 74 in the enclosure top 80 allows the pendant cord 72 to pass through the enclosure top 80 for connection to the circuit board 60. Alternatively, the pendant 70 may be configured with the circuit board 60 for wireless control of the pump system 10 (not shown). The pendant 70 includes a pendant circuit board 76 onto which pendant software is uploaded. The pendant 70 and pendant software are standard and can be can be used in connection with any pump system 10 configuration; the pendant 70 and pendant software are designed such that a pendant 70 can be plugged into the circuit board 60 of any pump system 10 configuration and allow the user to control the number of zones in her or her particular air mattress. The pendant 70 includes an LCD display 78 and control buttons 79 to allow the user to control the amount of air pumped from the pump 10 to each inflatable zone. The size of the LCD display 78 and number of control buttons 79 can of course vary. Alternatively, the LCD display 78 could be a touch screen on which firmless level is selected, or a track wheel or ball could be used for selection by a user. Multiple pendants 70 could also be used depending on the need for individual controllers in the system.

Figure 4:
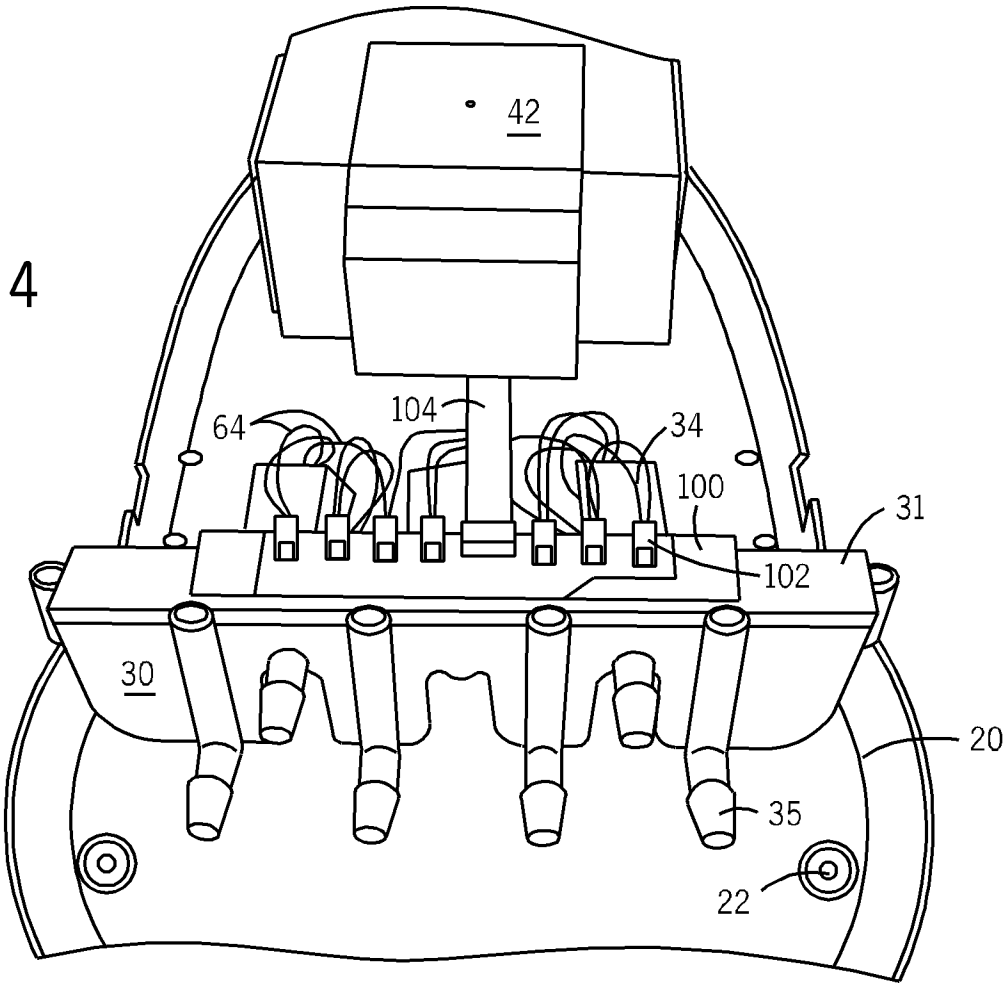
FIG. 4 is a front perspective view of a manifold, air control valves, a pony board and an air pump in accordance with one embodiment of the present invention.
Figure 5:
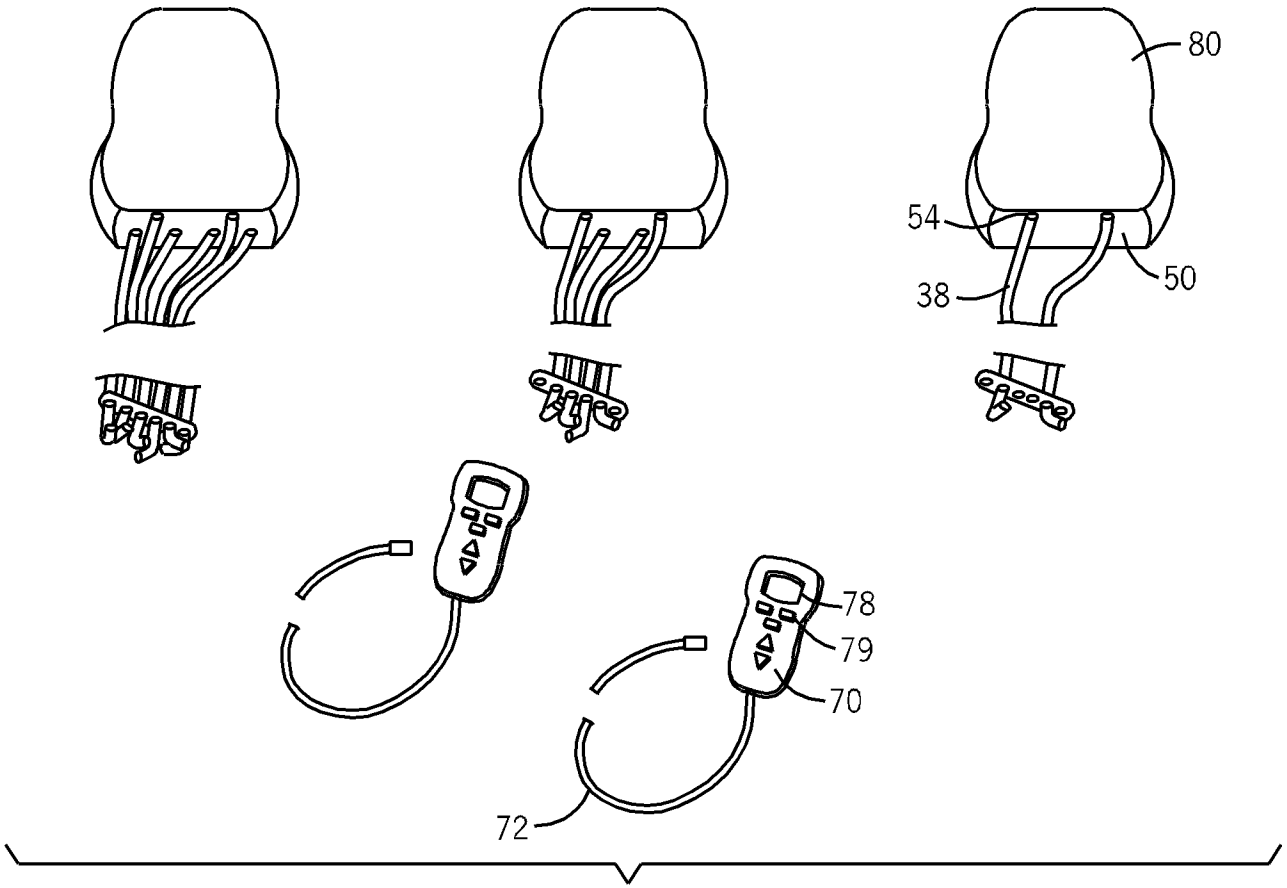
FIG. 5 is a front perspective view of three configurations of pump systems with enclosure tops.
Figure 14:
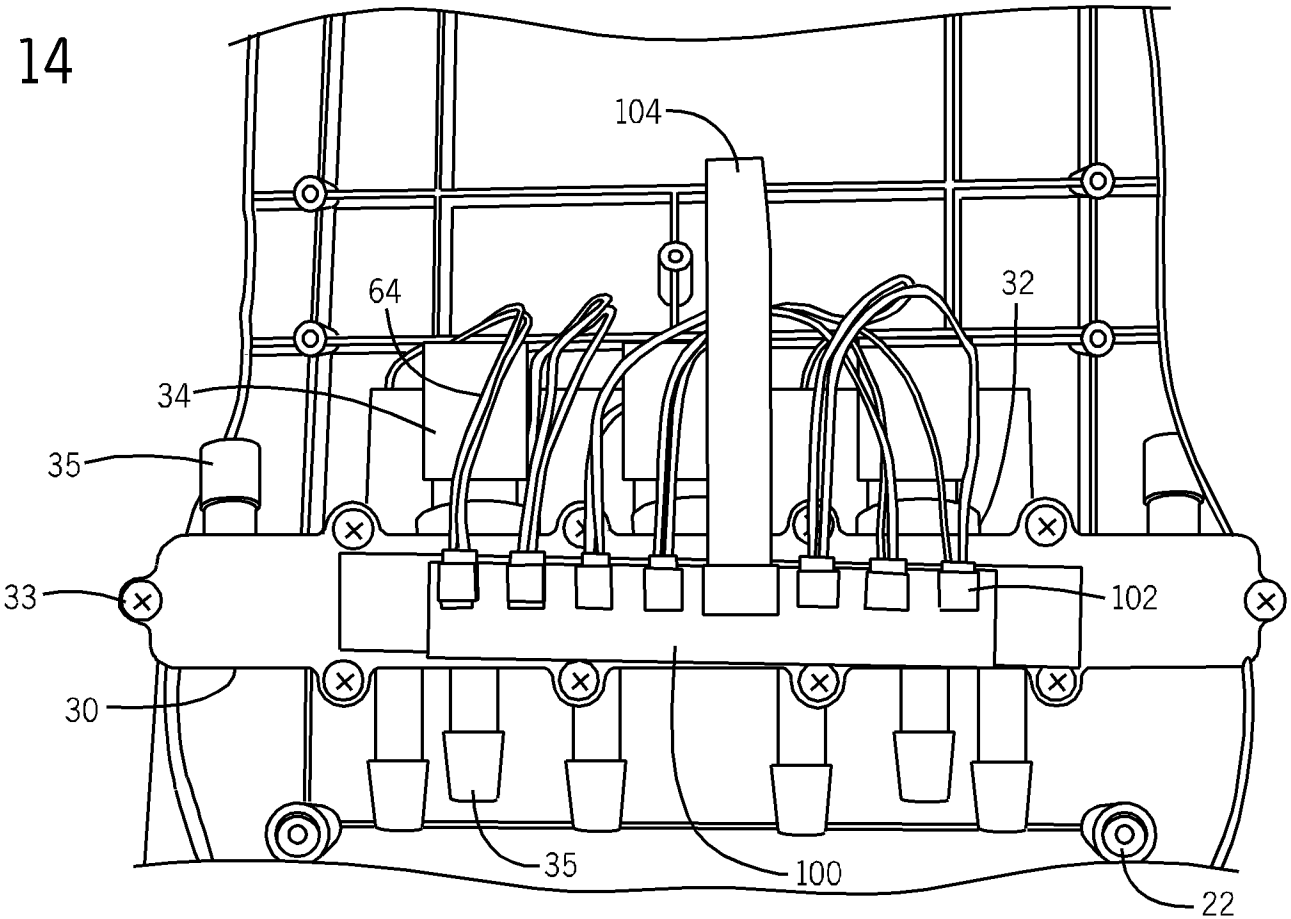
FIG. 14 is a top view of a manifold, a pony board, air valves, and air valve connective wires in accordance with one embodiment of the present invention.
Figure 15:
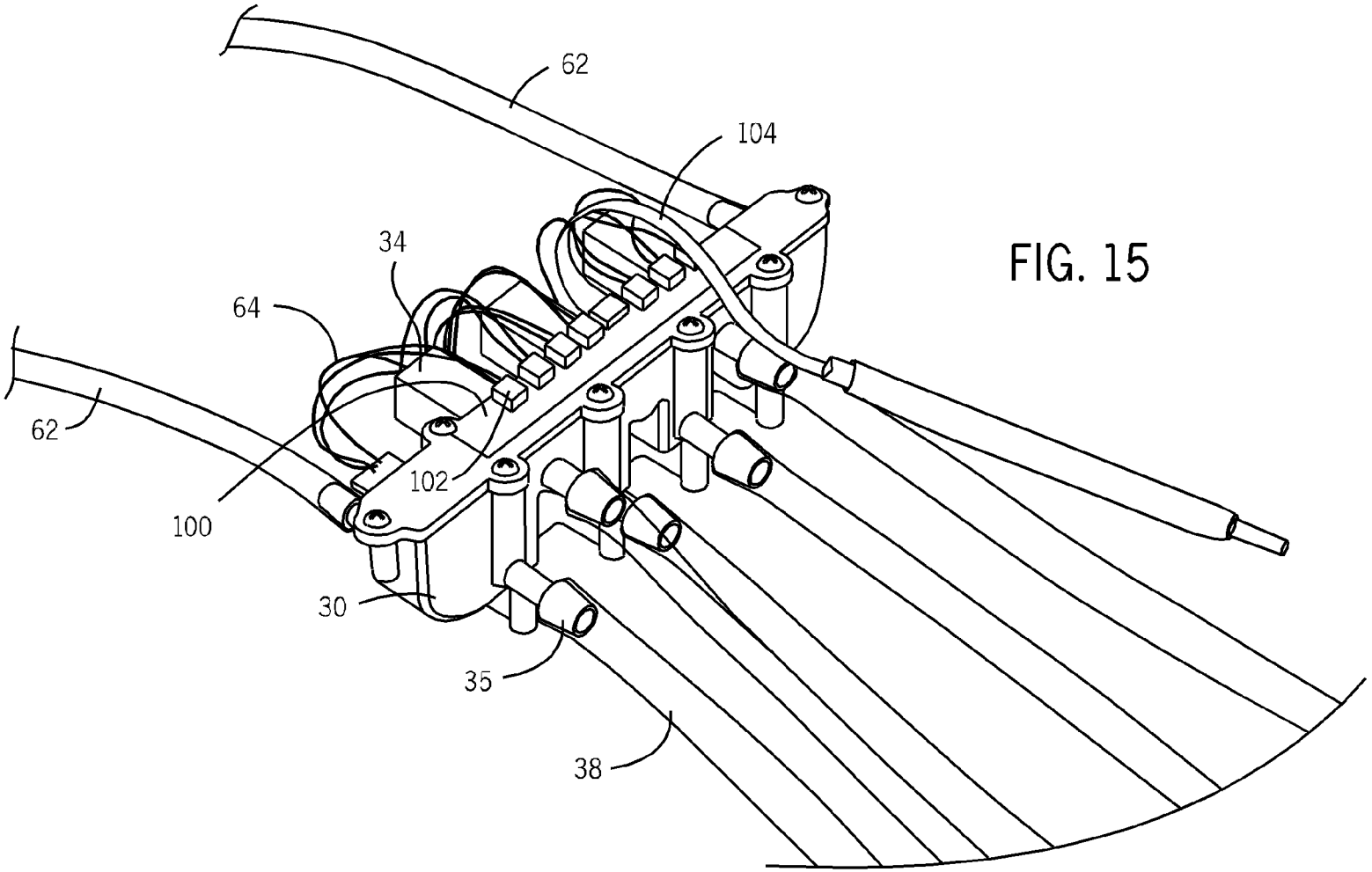
FIG. 15 is a side perspective view of a manifold and tubing of a pump system in accordance with one embodiment of the present invention.

As seen in FIGS. 4 and 14-15, the air control valves 34 may be connected to the circuit board 60 through a pony board 100 instead of directly to the circuit board 60 itself. In this embodiment, connective wires 64 connect the air control valves 34 to the pony board 60, which is then connected to the circuit board 60. The pony board 100 may be attached to the cover 31 of the manifold 30 by screws. This pony board 100 includes connection ports 102 equal to the maximum number of air control holes 32 in the manifold 30 and an output arm 104. In the embodiment shown in the FIGS., the pony board has seven connection ports 102, equal to the number of air control holes 32 in the manifold 30 shown. Of course, the pony board 100 could include a different number of ports 102 to accommodate the number of holes 32 in the manifold 30. The pony board 100 allows each air control valve connective wire 64 to be plugged into the pony board 100 instead of directly into the circuit board 60, with a single output arm 104 running from the pony board 100 to the circuit board 60. The output arm 104 provides for a single connection from the valves 34 to the circuit board 60 where multiple valves 60 are used, making connection of the pump 10 components faster and easier. It also provides for faster and simpler external testing of the valves 34 and manifold 30 by allowing connection of the single output arm 104 of the pony board 100 to a separate testing unit.

Although the invention has been herein described in what is perceived to be to most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description herein.

What is claimed is:

1. A customizable air pump system for providing air to a plurality of zones, the customizable air pump system comprising:

a platform;

a manifold mounted to the platform, the manifold operably connected to an air pump such that activation of the air pump provides air to the manifold, the manifold including a plurality of air control holes;

a number of air control valves related to the number of zones to be provided air, the air control valves operably inserted in the air control holes in the manifold;

a number of tubes related to the number of zones to be provided air, the tubes operably connected to the air control valves, the tubes for providing air to each of the zones;

wherein the number of air control valves and the number of tubes is equal to or less than the plurality of air control holes, such that the pump system is customizable for use with different numbers of air zones by selecting and relating the number of air control valves and tubes to the number of zones.

2. The customizable air pump system of claim 1 further comprising:

a pump casing substantially enclosing the pump system.

3. The customizable air pump system of claim 2 further comprising a faceplate through which tubes can pass, the faceplate selected based on the number of zones.

4. The customizable air pump system of claim 2 wherein the pump casing comprises a base platform and an enclosure top.

5. The customizable air pump system of claim 4, wherein the base platform is configured to receive air pumps of varying sizes.

6. The pump system of claim 1, wherein the pump system is configured for use with an air mattress having a plurality of inflatable zones.

7. The pump system of claim 1 further comprising a circuit board, the circuit board including software programmable for controlling the pump and operation of the air control valves.

8. The pump system of claim 7 further comprising a pony board connected to the air control valves and the circuit board.

9. The pump system of claim 8 wherein the pony board is connected to the circuit board by a single output arm.

10. An air mattress pump system for providing air to an air mattress having a plurality of inflatable zones, the air mattress pump system being customizable for use with air mattresses having differing numbers of inflatable zones and comprising:

a mounting area for receiving a pump;

a manifold mounted to the mounting area, the manifold operably connected to the pump such that activation of the pump provides air to the manifold, the manifold including a plurality of air control holes;

a number of air control valves related to the number of inflatable zones in the air mattress, the air control valves operably inserted in the air control holes in the manifold;

a number of tubes related to the number of inflatable zones in the air mattress for providing air to the inflatable zones, the tubes operably connected to the air control valves;

wherein the number of air control valves and the number of tubes is equal to or less than the plurality of air control holes, such that the air mattress pump system is customizable to the number of inflatable zones in the air mattress by selecting and relating the number of air control valves and tubes to the number of inflatable zones in the air mattress.

11. The air mattress pump system of claim 10 further comprising:

a pump casing substantially enclosing the air mattress pump system.

12. The air mattress pump system of claim 11 further comprising a faceplate through which tubes can pass, the faceplate selected based on the number of inflatable zones; wherein the mounting area is configured to receive pumps of varying sizes.

* * * * *